United States Patent [19]

Rhodes

[11] 4,039,109

[45] Aug. 2, 1977

[54] APPARATUS FOR PULLING A LINE

[76] Inventor: Herbert M. Rhodes, P.O. Box 8, Belle Chasse, La. 70037

[21] Appl. No.: 598,281

[22] Filed: July 23, 1975

[51] Int. Cl.[2] ..... B65H 17/34

[52] U.S. Cl. ..... 226/172; 100/154

[58] Field of Search ..... 226/171, 172, 173; 100/151, 152, 154, 153, 118–120; 198/162, 165

[56] References Cited

U.S. PATENT DOCUMENTS

| | | | |
|---|---|---|---|
| 1,702,085 | 2/1929 | Kerr | 100/119 X |
| 3,230,866 | 1/1966 | Branders | 100/151 X |
| 3,612,374 | 10/1971 | Shartzer | 226/172 |
| 3,620,432 | 11/1971 | Emery | 226/172 |

FOREIGN PATENT DOCUMENTS

| | | | |
|---|---|---|---|
| 903,100 | 6/1972 | Canada | 226/172 |

*Primary Examiner*—Richard A. Schacher
*Attorney, Agent, or Firm*—Morton, Bernard, Brown, Roberts & Sutherland

[57] ABSTRACT

Apparatus for pulling a line, particularly a line having a low coefficient of friction such as an endless line oil mop. A pair of endless belts are positioned so that their facing portions define a converging space. A plurality of slats are positioned on each endless belt oriented transverse the longitudinal axis thereof. On each endless belts the slats are alternately of a first hardness and a second, lesser hardness, with each hard slat on each belt being opposite a softer slat on the other belt. The softer slats deform somewhat, and so the line is crimped between the alternating hard and soft slats. Idler rollers deform the endless belts and the slats into the converging space to massage the line as it passes therethrough, and this massaging is enhanced by guide rails which cooperate with the idler rollers. An auxiliary endless belt unit can be provided adjacent the converging space outlet and having its facing portions traveling away from that outlet at a higher linear velocity than that of facing portions of the main unit. The resulting slippage between the auxiliary unit and the line reduces entanglement of the line and refluffs the fibers on an endless line oil mop. A three-tiered unit utilizing three endless belts to provide two converging areas can be constructed to give increased gripping of a line and increased cleaning of an oil mop.

19 Claims, 12 Drawing Figures

FIG. 1
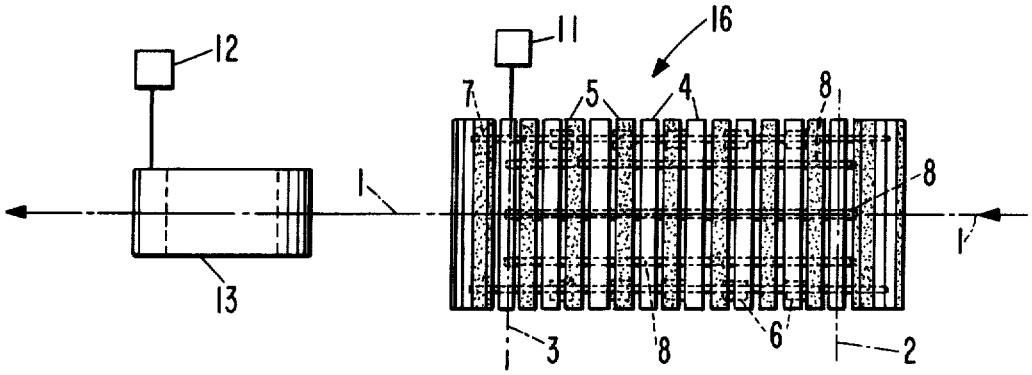
FIG. 2
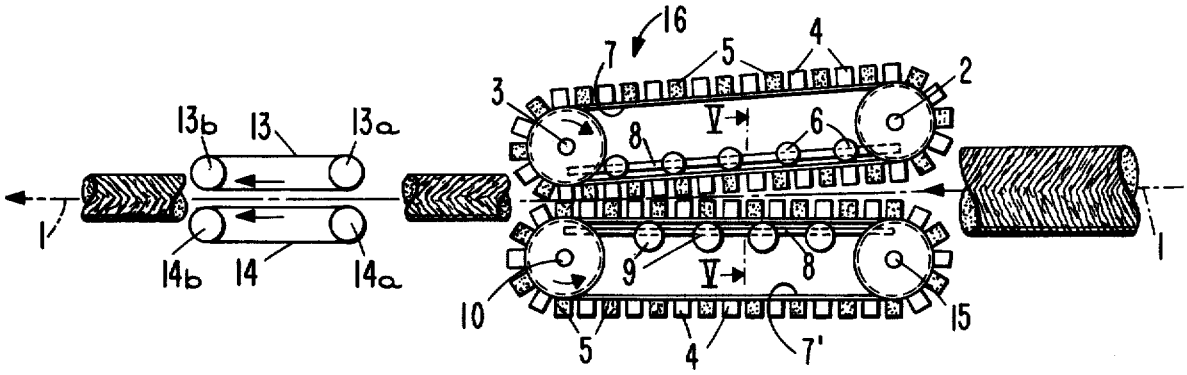
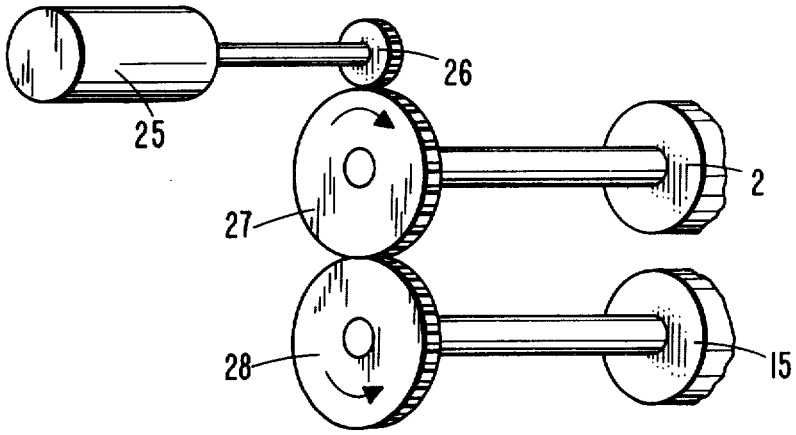
FIG. 2A

FIG. 3
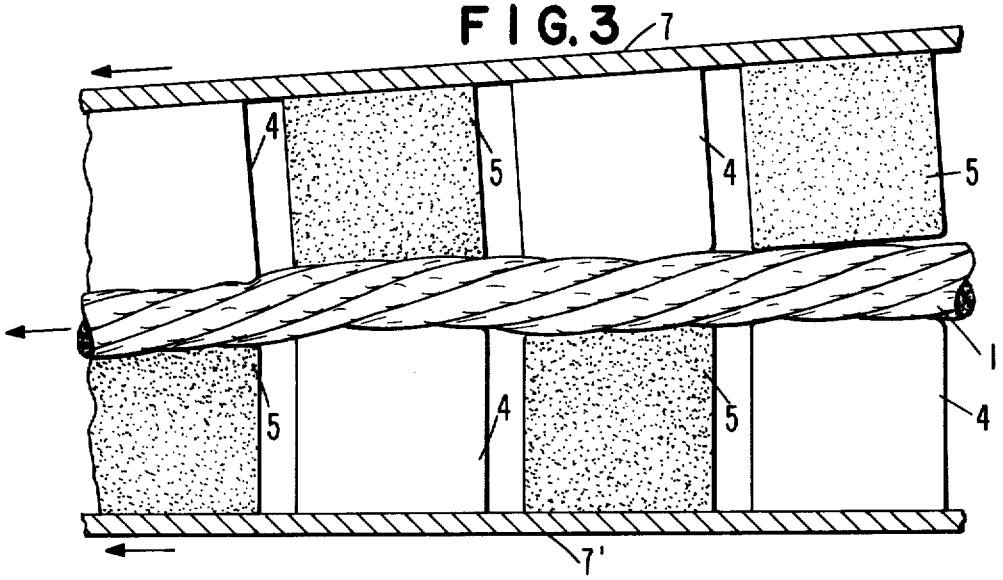
FIG. 4
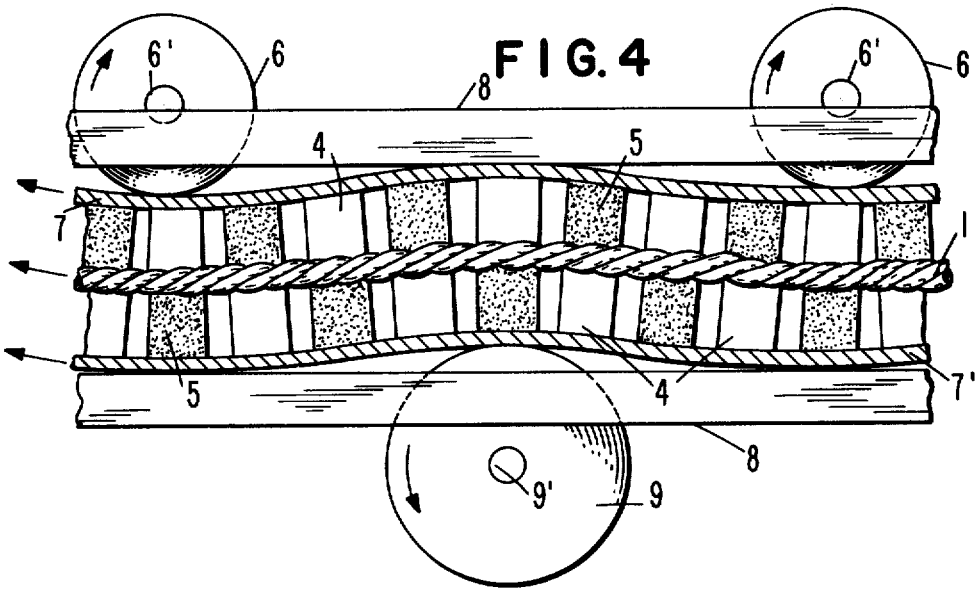
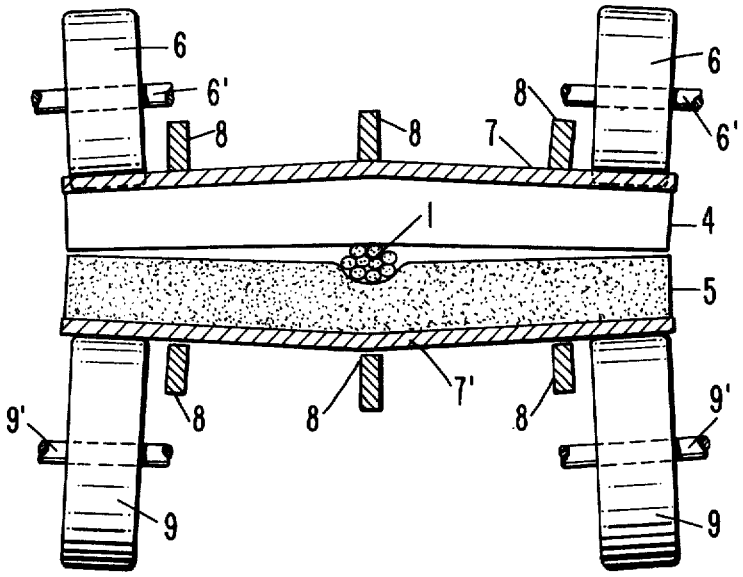
FIG. 5

FIG. 6
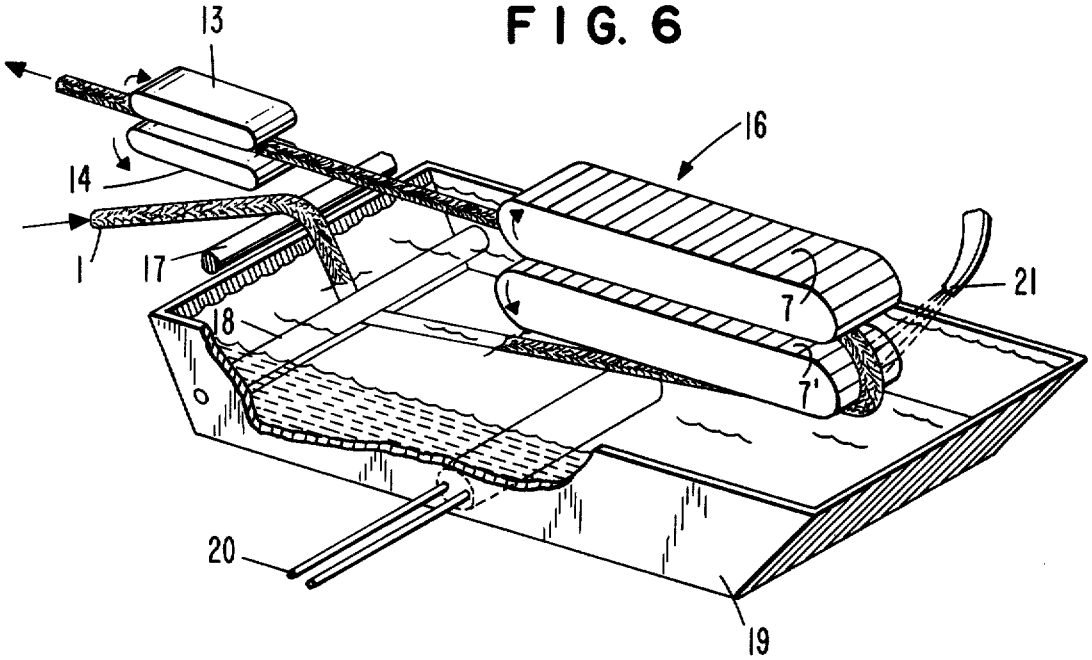
FIG. 7A
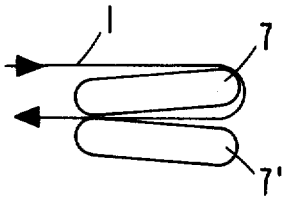
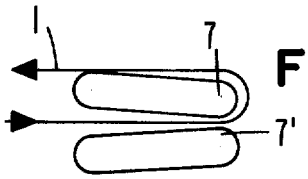
FIG. 7B
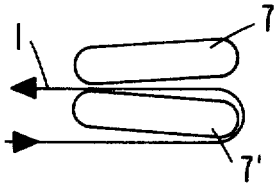
FIG. 7C
FIG. 8A
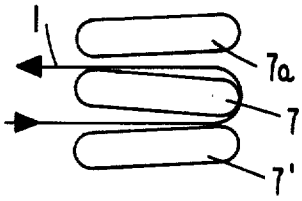
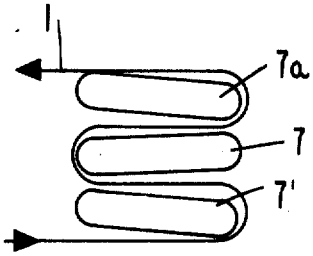
FIG. 8B

APPARATUS FOR PULLING A LINE

The present invention pertains to apparatus for pulling a cable, rope, oil mop, or other line. More particularly, the present invention pertains to an apparatus for pulling a line of low coefficient of friction with a high degree of gripping of the line. In the instance when the line is an oil mop, the present invention further removes oil from the mop.

In various operations, a line, such as a rope, a cable, or an oil mop, is pulled to bring the line and items attached thereto to a desired location. By way of example, endless line oil mops are often utilized for removing oil from the surface of water. One form of such endless line oil mop includes a line of, for example, a multi-strand polypropylene rope with a large number of strips of a relatively thin gauge polypropylene attached to the polypropylene rope. Each of the polypropylene strips might be about two to about five feet in length. The polypropylene rope with the strips attached thereto might have a length in the order of from about 100 to about 1000 feet, and the two ends of the rope are spliced together to form the endless rope oil mop. Such oil mops are shown, by way of example, in U.S. Pat. Nos. 3,668,118, issued June 6, 1972, and 3,744,638, issued July 10, 1973, both to Herbert M. Rhodes. These patents show endless line oil mops and apparatus for pulling the mops to enable their use in the removal of oil from the surface of a body of water. The oil mop shown in those patents is wrapped about pulleys, one of which is driven to pull the mop, and is passed through wringers to remove oil from the mop. While the apparatus shown in these patents is well suited for pulling the oil mop in relatively warm climates, experience has shown that because the oil becomes very viscous in colder climates, it is difficult, if not impossible for the apparatus to pull the endless line oil mop in the colder climates. The pull required for successful operation in viscous oils and greases, such as generally found in cold climates cannot be obtained with the driven pulley equipment described in these patents. A drum type pulling apparatus might be assembled capable of providing sufficient pull for use in colder climates, but such a drum-type apparatus would likely be so large and would likely require so great an amount of power as to be impractical. In addition, the endless line oil mop pulled by such a high power drum-type apparatus would be subjected to shearing and fraying.

The present invention is an apparatus for pulling a line, particularly a line having a low coefficient of friction such as an endless line oil mop. In accordance with the present invention, first and second endless belts are positioned adjacent and substantially coextensive with each other with their longitudinal axes defining a plane and with their facing portions defining a converging space having an outlet at its narrower end. A plurality of slat members are positioned on the endless belts transverse the longitudinal axes thereof. The line to be pulled passes through the converging space to the outlet and is gripped by the slats on each endless belt, with the degree of gripping increasing as the line passes further into the converging space. The size of the outlet can be adjusted to provide a degree of gripping sufficient to pull the line. Preferably, the slats on the endless belts include a first set of slats of a first hardness and a second set of slats of a second hardness less than the first hardness, with the slats of the first and second sets alternating on each endless belt and positioned so that each hard slat on one endless belts is opposite a soft slat on the other endless belt. Consequently, as the rope encounters the slats, the rope is crimped between the adjacent hard and soft slats to increase the gripping of the apparatus. Preferably, also, pairs of idler rollers are positioned adjacent each endless belt with the idler rollers of the two endless belts alternated along the facing portions thereof to deform the belt into the converging space adjacent each idler roller. This alternately imparts and releases compression on the line, thus massaging the line as it is pulled and so lessening the likelihood of shearing or fraying of the line. Guide rails can be provided to cooperate with the idler rollers to enhance this massaging of the line. If desired, an auxiliary endless belt unit can be provided adjacent the outlet of the principal pulling unit, with the auxiliary unit having very thin slats or no slats, and operating at a higher speed to provide slippage on the line, with a resultant reduction in the likelihood of any entanglement of the line. Such slippage also results in refluffing of the strips of an endless line oil mop. When the line is an endless line oil mop, it can be heated to enhance the release of oil therefrom, and the release of oil can be increased by the addition of water to displace oil from the line prior to entry into the converging space between the endless belts. A two-tiered apparatus can be provided having two endless belts with a single converging space. Alternatively, a three-tiered apparatus can be provided having three endless belts with two converging spaces for increased gripping and oil releasing action. The path by which the line is threaded through the two-tiered or three-tiered apparatus can be altered as desired. Preferably, the path results in the uncleaned portion of an endless line oil mop passing beneath the cleaned portion so that oil and other contaminants do not fall from the uncleaned portion onto the cleaned portion. Preferably, also, for a significant portion of its travel prior to entry into the converging space, the uncleaned portion is submerged in the water from which the oil is being cleaned for improved heat transfer and to prevent unwarranted spreading of the oil or other contaminants. If desired, the oil and water removed from the line can be separated after removal.

These and other aspects and advantages of the present invention are more apparent in the following detaled description and claims, particularly when considered in conjunction with the accompanying drawings in which like parts bear like reference numerals.

In the drawings:

FIG. 1 is a top plan view of apparatus in accordance with the present invention;

FIG. 2 is a side elevational view of the apparatus of FIG. 1:

FIG. 2A illustrates a drive system for apparatus in accordance with the present invention;

FIG. 3 is an enlarged, fragmentary, side elevational view showing details of the apparatus of FIG. 1;

FIG. 4 is an enlarged, fragmentary, side elevational view showing other details of the apparatus in FIG. 1;

FIG. 5 is an enlarged sectional view taken on line V—V of FIG. 2;

FIG. 6 is a perspective view partially broken, illustrating a preferred embodiment of apparatus in accordance with the present invention;

FIGS. 7A, 7B, and 7C depict alternative modes of operation of apparatus in accordance with the present invention; and FIGS. 8A and 8B depict further alternative embodiments and further alternative modes of operation of apparatus in accordance with the present invention.

FIGS. 1 and 2 depict a drawworks 16 for a line, in accordance with the present invention, including a first endless belt 7 wrapped about wheels 2 and 3, one of which is driven, and a second endless belt 7' wrapped about wheels 10 and 15, one of which is driven. Wheels 2 and 3 and wheels 10 and 15 are positioned so that the two endless belts 7 and 7' are adjacent each other and, as seen from the top plan view of FIG. 1, endless belts 7 and 7' have their longitudinal axes substantially coextensive to define a plane, while, as seen from FIG. 2, the facing portions of endless belts 7 and 7' define a converging space. A plurality of slats 4, of a first hardness, are mounted upon each endless belt 7 and 7' oriented transverse the longitudinal axes thereof. A like plurality of slats 5, of a second hardness less than that of slats 4, are positioned on endless belts 7 and 7' also transverse the longitudinal axes of the endless belts, with the slats 4 and 5 alternating on each endless belt. By way of example, slats 4 and 5 might be formed of a polyurethane or of neoprene, with the slats 4 having a Durometer A hardness in the range of from about 50 to about 95 and with the slats 5 have a Durometer A hardness in the range of from about 15 to about 45. As seen in FIG. 2, the hard slats 4 and soft slats 5 are arranged so that a hard slat 4 on upper endless belt 7 is opposite each soft slat 5 on lower endless belt 7', while a soft slat 5 on upper endless belt 7 is opposite each hard slat 4 on lower endless belt 7'. The upper and lower endless belts 7 are driven in synchronism to maintain this relationahip.

FIG. 2A depicts a drive system suitable for maintaining the desired relationship between the slats so that each hard slat on one belt is opposite a soft slat of the other belt. Motor 25 drives gear 26 which drives gear 27. Gear 27, in turn drives gear 28. Thus, if gear 27 is driven clockwise in FIG. 2A, then gear 28 is driven counterclockwise. Gear 27 is coupled to drive wheel 2 of endless belt 7, while gear 28 is coupled to drive wheel 15 of endless belt 7'. Hence, endless belts 7 and 7' are driven together so that the facing portions thereof travel with equal linear velocities toward the narrower end of the converging space between the endless belts.

As seen in FIGs. 2 and 5, a plurality of pairs of idler rollers 6 are provided over the length of the facing portion of upper endless belt 7, and a plurality of pairs of idler rollers 9 are provided over the length of the facing portion of lower endless belt 7'. As seen in FIG. 5, one idler roller of each pair is positioned adjacent each outer edge of endless belts 7 and 7'. A plurality of guide rails 8 are provided within the path of travel of each endless belt 7 and 7' and adjacent the inner surface of the facing portions of the endless belts so that the guide rails 8 are positioned intermediate the idler rollers 6 or 9 of each pair of idler rollers of the associated endless belt. Each pair of idler rollers 6 is mounted on an axle 6', while each pair of idler rollers 9 is mounted on an axle 9'. Suitable framework (not shown) is provided to hold the axles 6' and 9' stationary so that idler rollers 6 and 9 cannot move either vertically or horizontally but only can rotate about their fixed axles. The idler rollers 6 and 9 are made of relatively hard material such as cast iron, while the guide rails 8 are made of a rigid material such as brass.

Preferably, as depicted in FIG. 4, idler rollers 9 are of a larger diameter than are idler rollers 6. The diameter of idler rollers 9 might be one-and-a-half to two-and-a-half times that of idler rollers 6. As one representative example, each idler roller 9 might have a diameter in the order of about 6 inches while each idler roller 6 might have a diameter in the order of about 3 inches.

As seen in FIGS. 1 and 2, a line 1 is drawn through the converging space between the hard slats 4 and the soft slats 5 of upper endless belt 7 and lower endless belt 7'. Line 1 may be a rope, a cable, or an endless line oil mop. Endless line 1 enters the converging space adjacent rollers 2 and 15 and progresses into the continually narrowing space between belts 7 and 7', emerging from the outlet at the narrower end of the converging space. Consequently, the grip exerted on line 1 increases as line 1 passes further into the converging space. Adjustment means 11 are provided to permit adjustment of the size of the outlet from the converging space of drawworks 16, thus permitting adjustment of the degree of gripping exerted on line 1. By way of examples, adjustment means 11 might be weights, springs, or hydraulic or pneumatic pistons, each permitting suitable adjustment for the desired degree of gripping of the particular type and size of line to be pulled.

As seen in FIG. 3, because hard slats 4 and soft slats 5 are positioned on endless belts 7 and 7' with the hard and soft slats alternating on each endless belt and with a hard slat 4 opposite each soft slat 5, and vice versa, line 1 is somewhat crimped by the slats. Each hard slat 4 compresses line 1 slightly into the opposite soft slat 5 to cause such crimping. The degree of crimp is controlled by the amount of compression and the relative hardness between the hard slats 4 and the soft slats 5. Generally, the relative difference of the hardness between the slats 4 and 5 decreases as the diameter and hardness of line 1 increases. The width and height of the slats, while not critical, generally increases as the diameter of line 1 increases. The height of the individual slats may be in the order of about three times the diameter of line 1; however, on small lines, say one-fourth inch in diameter and less, the ratio of height to line diameter may be considerably greater. The spacing between adjacent slats 4 and 5 on each endless belt 7 and 7' may be in the order of about one-fourth the width of the slats; however, this again may vary for small lines.

As seen from FIGS. 4 and 5, idler rollers 6 and 9, which are alternately positioned relative the longitudinal axes of endless belts 7 and 7', impart a gentle massaging to line 1 as the line and the endless belts 7 and 7' progress past the rollers 6 and 9. As lower endless belt 7', with its slats 4 and 5 and the line 1, travels over each roller 9, a maximum degree of compression is imparted. Conversely, between adjacent rollers 6 and 9 the compression is released, and beneath each roller 6 a second compression, less than the compression due to each roller 9, is imparted. Guide rails 8 cooperate with idler rollers 6 and 9 to enhance this compression, since the belts 7 and 7', slats 4 and 5, and line 1 are squeezed between the rollers 6 and 9 and the guide rails 8. Thus, the endless belts 7 and 7', slats 4 and 5 and line 1 are compressed between each idler roller 9 and the guide rails 8 of the upper endless belt 7, and are again compressed between each idler roller 6 and the lower guide rails 8 of lower endless belt 7'. Because idler rollers 6 are of a smaller diameter than idler rollers 9, the idler rollers 6 impart less compression.

This imparting of a maximum degree of compression, release of compression, and imparting of a second, lesser degree of compression results in a gentle massaging of line 1 as it is drawn, thus lessening the likelihood of shearing or fraying of the line. Each time the compression is released, line 1 repositions itself to relieve the stress on its individual fibers. The crimping imparted by the alternating hard slats 4 and soft slats 5 and the massaging imparted by the alternating roller 6 and 9 increase the amount of pull which can be imparted to line 1 by drawworks 16. As a consequence, the factor limiting the amount of pull which can be imparted to line 1 is the shear strength of the line.

As seen in FIGS. 1 and 2, an auxiliary endless belt unit is provided adjacent the outlet of the endless belts 7 and 7' so that after passing from endless belts 7 and 7', line 1 passes through the auxiliary unit. This auxiliary unit is made up of upper endless belt 13, which passes around wheels 13*a* and 13*b*, one of which is driven, and lower endless belt 14, which passes around wheels 14*a* and 14*b*, one of which is driven. Endless belts 13 and 14 have their longitudinal axes substantially coextensive to define a plane. Adjustment means 12 are provided to control the size of the passage defined between the facing portions of endless belts 13 and 14. Endless belts 13 and 14 are of a construction similar to that of endless belts 7 and 7', however, the endless belts 13 and 14 need not converge, and belts 13 and 14 can be provided with no slats on them or, alternatively, with a slat of a minimum height, say a height in the order of about one-fourth inch. The facing portions of endless belts 13 and 14 travel at the same speed, having a slightly higher linear velocity than do the facing portions of endless belts 7 and 7'. The facing portions of endless belts 13 and 14 travel away from the outlet of endless belts 7 and 7'. The higher velocity of endless belts 13 and 14 and the lack of significant slats on endless belts 13 and 14 results in slippage between line 1 and endless belts 13 and 14. This slippage reduces the likelihood of any entanglement of line 1 as it leaves slats 4 and 5 on belts 7 and 7'. In addition, when line 1 is an oil mop, the slippage of auxiliary belts 13 and 14 refluffs the strips or fibers of the mop, since that slippage pulls the fibers forward with respect to the line of the oil mop. This refluffing enhances the pick-up capacity of such an oil mop by exposing more of the fibers to the oil.

When operating in a cold climate, by way of example when using drawworks 16 to draw an oil mop in water in a northern region where the water is cold, it is desirable to heat line 1. FIG. 6 illustrates apparatus for achieving this. As seen in FIG. 6, line 1 is drawn by drawworks 16 so that line 1 passes about guide rollers 17 and 18 which guide the line 1 into a vessel 19 filled with water. A heating element 20 is provided to heat the water in vessel 19. Line 1 thus passes about rollers 17 and 18, through the heated water of vessel 19, and then into the converging space of drawworks 16. In addition to aiding in the release of oil from an oil mop, the heated water increases the degree of crimp which can be imparted to line 1, thus increasing the drawing power of drawworks 16. Likewise, as shown in FIG. 6, a fluid souce 21 can be provided to add water to line 1 just as the line 1 enters drawworks 16. This added water displaces oil in line 1, thus increasing the cleaning of oil achieved by the present invention.

Where the present invention is being used to move an oil mop on a body of water, generally the oil mop is an endless line mop being drawn from and returned to the same direction, as shown in U.S. Pat. Nos. 3,668,118 and 3,744,638. The embodiment of the drawworks depicted in FIGS. 1 through 6, in which two endless belts wih one converging area are utilized, presents several alternative paths which the oil mop might follow. A number of these are illustrated in FIGs. 7A, 7B and 7C. FIG. 7A shows the oil mop 1 being drawn above upper endless belt 7 and then passed through the converging area between upper endless belt 7 and lower endless belt 7'. This is undesirable since the uncleaned portion of the oil mop travels in a path above the return path of the cleaned portion of the oil mop, with the result that oil and other contaminants are likely to fall from the uncleaned portion of the oil mop onto the cleaned portion. FIG. 7B corrects this by drawing oil mop 1 into the converging area between endless belts 7 and 7' and returning the oil mop above endless belt 7. The preferred path, however, is depicted in FIG. 7C, in which oil mop 1 is drawn beneath lower endless belt 7' and returned through the converging area between belts 7 and 7'. Not only is the return path of the cleaned mop portion above the inlet path of the dirty mop portion, but also inlet path of the dirty mop portion can be submerged in the water from which the oil is being cleaned. This submerged path of the uncleaned oil mop portion is preferred for its improved heat transfer characteristics and to prevent unwarrented spreading of the oil or other contaminants.

The two-tiered drawworks of FIGS. 1 through 7 cleans a considerable amount of oil or other contaminants from an oil mop and provides a sure gripping of a line being drawn by drawworks 10. Improved gripping and improved cleaning can be provided in a three-tiered drawworks, utilizing three endless belts positioned one above the other to provide two converging areas. FIGS. 8A and 8B depict alternative paths of travel of line 1 through such a three-tiered drawworks. As depicted in FIG. 8A, the three-tiered drawworks includes lower endless belt 7', intermediate endless belt 7 and upper endless belt 7*a*. A first converging area is defined between the facing portions of lower endless belt 7' and intermediate endless belt 7. A second converging area is defined between the facing portions of intermediate endless belt 7 and upper endless belt 7*a*. Endless belts 7, 7' and 7*a* have their longitudinal axes substantially parallel and are oriented so that the outlets from the narrower ends of the two converging areas are at longitudinally opposite ends of the endless belts. Line 1 is drawn into the first converging area between endless belts 7' and 7, curves around intermediate endless belt 7, and passes through the second converging area between endless belts 7 and 7*a*. The utilization of two converging areas increases the gripping on the line and, in the event the line is an oil mop, increases the cleaning of that oil mop. FIG. 8B depicts a preferred path of travel for line 1 with a three-tiered apparatus. Line 1 is drawn beneath lower endless belt 7', curves about belt 7', and passes through the first converging area between lower endless belt 7' and intermediate endless belt 7. Line 1 then curves about endless belt 7 to pass through the second converging area between endless belt 7 and upper endless belt 7*a*. Line 1 then curves around upper endless belt 7*a* to its return path.

Endless belts 7, 7', 13 and 14 can be of any suitable material. By way of examples, they might be a steel ribboned flexible endless belt or a slatted roller chain. The amount of compression exerted by adjustment means 11 and 12 is selected for the particular line being pulled and the ambient conditions. If weights are utilized, adjustment means 11 might be a weight in the order of from about 10 to about 500 pounds, and adjustment means 12 might be a weight in the order of from about 2 to about 30 pounds. Likewise, the linear velocity of endless belts 7 and 7' depends upon the particular situation and might be from about three to about 250 feet per minute, for example. The apparatus of the present invention provides improved, thorough gripping of a line and cleaning of an oil mop. Although the present invention has been described with reference to preferred embodiments, numerous rearrangements and modifications could be made, and still the result would be within the scope of the invention.

What is claimed is:

1. Apparatus for pulling a line comprising:

a first endless belt having a longitudinal axis;

a second endless belt having a longitudinal axis and positioned adjacent and substantially coextensive with said first endless belt, with said first endless belt longitudinal axis and said second endless belt longitudinal axis defining a plane and with the facing portions of said first and second endless belts defining a first converging space having an outlet adjacent the narrower end thereof;

a plurality of first slat members positioned on said first endless belt transverse said first endless belt longitudinal axis;

a plurality of second slat members positioned on said second endless belt transverse said second endless belt longitudinal axis, with each second slat member opposite one of said first slat members and forming with its oppositely positioned first slat member a pair of cooperating slat members;

means for moving said first endless belt in a first endless path and said second endless belt in a second endless path with the facing portions of said first and second endless belts moving at substantially equal velocities toward the narrower end of the converging space to pull a line through the converging space to the outlet thereof; at least some of said pairs of cooperating slat members include one slat having a first hardness and another slat having a second hardness different from said first hardness to thereby crimp the line as it moves through the converging space to the outlet thereof.

2. Apparatus as claimed in claim 1 in which:

each pair of cooperating slat members include one slat of the first hardness and one slat of the second hardness;

said first slat members are alternately of the first and the second hardness; and said second slat members are alternately of the first and the second hardness.

3. Apparatus as claimed in claim 2 further comprising adjustment means for adjusting the size of the converging space outlet.

4. Apparatus as claimed in claim 1 in which the plane defined by said first endless belt longitudinal axis and said second endless belt longitudinal axis is a vertical plane.

5. Apparatus as claimed in claim 1 further comprising means for adding water to a line entering the converging space.

6. Apparatus for pulling a line comprising:

a first endless belt having a longitudinal axis;

a second endless belt having a longitudinal axis and positioned adjacent and substantially coextensive with said first endless belt, with said first endless belt longitudinal axis and said second endless belt longitudinal axis defining a plane and with the facing portions of said first and second endless belts defining a first converging space having an outlet adjacent the narrower end thereof;

a plurality of first slat members positioned on said first endless belt transverse said first endless belt longitudinal axis;

a plurality of second slat members positioned on said second endless belt transverse said second endless belt longitudinal axis, with each second slat member opposite one of said first slat members;

means for moving said first endless belt in a first endless path and said second endless belt in a second endless path with the facing portions of said first and second endless belts moving at substantially equal velocities toward the narrower end of the converging space to pull a line through the converging space to the outlet thereof; and a plurality of first pairs of idler rollers spaced along said first endless belt longitudinal axis and a plurality of second pairs of idler rollers spaced along said second endless belt longitudinal axis and alternating with said first pairs of idler rollers, each idler roller bearing against its associated endless belt to deform said endless belts into the converging space adjacent said idler rollers to massage a line being pulled through the converging space.

7. Apparatus as claimed in claim 6 in which said first idler rollers are each of a first diameter and said second idler rollers are each of a second diameter greater than the first diameter.

8. Apparatus as claimed in claim 7 in which the second diameter is in the order of from about one-and-a-half to about two-and-a-half times the first diameter.

9. Apparatus as claimed in claim 8 in which the first diameter is in the order of from 3 inches and the second diameter is in the order of about 6 inches.

10. Apparatus as claimed in claim 6 further comprising a plurality of first guide rails extending along said first endless belt longitudinal axis intermediate the idler wheels of each of said first pairs and a plurality of second guide rails extending along said second endless belt longitudinal axis intermediate the idler wheels of each of said second pairs, said guide rails cooperating with said idler wheels to massage a line being pulled through the converging space.

11. Apparatus for pulling a line comprising:

a first endless belt having a longitudinal axis;

a second endless belt having a longitudinal axis and positioned adjacent and substantially coextensive with said first endless belt, with said first endless belt longitudinal axis and said second endless belt longitudinal axis defining a plane and with the facing portions of said first and second endless belts defining a first converging space having an outlet adjacent the narrower end thereof;

a plurality of first slat members positioned on said first endless belt transverse said first endless belt longitudinal axis;

a plurality of second slat members positioned on said second endless belt transverse said second endless belt longitudinal axis, with each second slat member opposite one of said first slat members;

means for moving said first endless belt in a first endless path and said second endless belt in a second endless path with the facing portions of said first and second endless belts moving at substantially equal velocities toward the narrower end of the converging space to pull a line through the converging space to the outlet thereof;

a third endless belt having a longitudinal axis;

a fourth endless belt having a longitudinal axis, and positioned adjacent and substantially coextensive with said third endless belt, with said third endless belt longitudinal axis and said fourth endless belt longitudinal axis defining a plane and with the facing portions of said third and fourth endless belts defining a passage adjacent the outlet of the converging space; and means for moving said third endless belt in a third endless path and said fourth endless belt in a fourth endless path with the facing portions of said third and fourth endless belts moving away from the outlet of the converging space at substantially equal velocities, greater than the velocities of the facing portions of said first and second endless belts.

12. Apparatus as claimed in claim 11 further comprising first adjustment means for adjusting the size of the converging space outlet and second adjustment means for adjusting the size of the passage.

13. Apparatus as claimed in claim 11 in which said third endless belt longitudinal axis and said fourth endless belt longitudinal axis define substantially the same plane as do said first endless belt longitudinal axis and said second endless belt longitudinal axis.

14. Apparatus as claimed in claim 13 in which the plane defined by said first endless belt longitudinal axis and said second endless belt longitudinal axis is a vertical plane.

15. Apparatus for pulling a line comprising:

a first endless belt having a longitudinal axis;

a second endless belt having a longitudinal axis and positioned adjacent and substantially coextensive with said first endless belt, with said first endless belt longitudinal axis and said second second endless belt longitudinal axis defining a plane and with the facing portions of said first and second endless belts defining a first converging space having an outlet adjacent the narrower end thereof;

a plurality of first slat members positioned on said first endless belt transverse said first endless belt longitudinal axis;

a plurality of second slat members positioned on said second endless belt transverse said second endless belt longitudinal axis, with each second slat member opposite one of said first slat members;

means for moving said first endless belt in a first endless path and said second endless belt in a second endless path with the facing portions of said first and second endless belts moving at substantially equal velocities toward the narrower end of the converging space to pull a line through the converging space to the outlet thereof; and heating means for heating a line prior to entry of the line into the converging space.

16. Apparatus as claimed in claim 15 in which the heating means comprises a vessel for holding water; means for heating water in said vessel; and guide means for guiding a line through water within said vessel and then to the converging space.

17. Apparatus as claimed in claim 16 further comprising means for adding water to a line entering the converging space.

18. Apparatus for pulling a line comprising:

a first endless belt having a longitudinal axis;

a second endless belt having a longitudinal axis and positioned adjacent and substantially coextensive with said first endless belt, with said first endless belt longitudinal axis and said second endless belt longitudinal axis defining a plane with the facing portions of said first and second endless belts defining a first converging space having an outlet adjacent the narrower end thereof;

a plurality of first slat members positioned on said first endless belt transverse said first endless belt longitudinal axis;

a plurality of second slat members positioned on said second endless belt transverse said second endless belt longitudinal axis, with each second slat member opposite one of said first slat members;

means for moving said first endless belt in a first endless path and said second endless belt in a second endless path with the facing portions of said first and second endless belts moving at substantially equal velocities toward the narrower end of the converging space to pull a line through the converging space to the outlet thereof; and a third endless belt having a longitudinal axis and positioned adjacent said second endless belt, with said second endless belt longitudinal axis substantially parallel with said third endless belt longitudinal axis and with facing portions of said second and third endless belts defining a second converging space having an outlet adjacent the narrower end thereof, the first converging space outlet and the second converging space outlet being at longitudinally opposite ends of said endless belts.

19. Apparatus as claimed in claim 18 in which the plane defined by said first endless belt longitudinal axis and said second endless belt longitudinal axis is a vertical plane.

* * * * *